US005104259A

United States Patent [19]

Svensson

[11] Patent Number: 5,104,259

[45] Date of Patent: Apr. 14, 1992

[54] METHOD FOR EXCAVATING ROCK CAVITIES

[75] Inventor: Kurt Svensson, Köping, Sweden

[73] Assignee: Kurt Svensson Grävmaskiner Aktiebolag, Köping, Sweden

[21] Appl. No.: 621,984

[22] Filed: Dec. 4, 1990

[30] Foreign Application Priority Data

Dec. 6, 1989 [SE] Sweden ..... 8904115

[51] Int. Cl.[5] ..... B65G 5/00; E21D 13/02

[52] U.S. Cl. ..... 405/55; 299/13; 405/139

[58] Field of Search ..... 405/53, 55, 132, 133, 405/138, 139, 140, 259, 260; 299/11, 13

[56] References Cited

U.S. PATENT DOCUMENTS

| | | | |
|---|---|---|---|
| 3,968,655 | 7/1976 | McGlothlin | 405/139 |
| 3,996,751 | 12/1976 | Hallenius | 405/139 |
| 4,474,506 | 10/1984 | Sagefors | 405/55 |
| 4,601,518 | 7/1986 | Lanéus | 299/13 |
| 4,708,523 | 11/1987 | Sagefors et al. | 405/55 |

FOREIGN PATENT DOCUMENTS

| | | |
|---|---|---|
| 0198808 | 10/1986 | European Pat. Off. . |
| WO/8601854 | 3/1986 | PCT Int'l Appl. . |

*Primary Examiner*—David H. Corbin

*Attorney, Agent, or Firm*—Brumbaugh, Graves, Donohue & Raymond

[57] ABSTRACT

The present invention relates to a method for excavating and preparation of rock cavities and then substantially spherical rock cavities or rock cavities having spherically shaped parts, such as dome-shaped ceilings, which rock cavities are intended as shelter, for the storage of solid or liquid products or for production plants in rock, whereby one drills a first series of radially outwardly extending holes (6) from a first distance (4) from one or more shafts/tunnels (3, 13, 14, 15, 16), preferably radially arranged from the center of a sphere projected; that one drills a second series of radially outwardly extending holes (8) from a second, far more out arranged distance (7) from the center, which holes (8) extend outside the holes of the first series; that one drills a third series of radially outwardly extending holes (10) from a third, further far more out arranged distance (9) from the center, which holes (10) extend outside the holes (8) of the second series; that optionally further series of holes (12) are drilled from further far out situated distances (11) extending radially outwardly up to the boundaries of the cavity (1); that the first series of holes (6) are charged in their whole lengths; that each further series of holes (8, 10, 12) are charged in that part which lies outside a charging area of a previous series of holes (6, 8, 10) up to the touching point of a next series of holes (10, 12), whereby the charges will take consecutive annular charging areas, which cover the shape of the spherical cavity projected, and that blasting takes place of each annular area per se starting from outside in, or vice verse.

12 Claims, 8 Drawing Sheets

METHOD FOR EXCAVATING ROCK CAVITIES

DESCRIPTION

1. Technical Field

The present invention relates to a method for excavating and preparation of rock cavities and then substantially spherical rock cavities or rock cavities having spherically shaped parts, such as dome-shaped ceilings, which rock cavities are intended as shelter, for the storage of solid or liquid products or for production plants in rock.

The object of the present invention is to obtain a possibility to produce rock cavities comprising spherical or partly spherical outer contours in a simple and rational way.

2. Background of the Invention

It is previously known (SE-C-8501647-5; SE-C-8404728-1) to produce large spaces in rock, spaces intended for storing liquid and solid products or for placing a production plant therein, such as power plants or for other materials in a situation of crisis, or for the storage of used nuclear fuel. These spaces consists of substantially cylindrical or polygonal vertical cavities, where one managed to deal with the stress on the ceiling/roof from masses above by arranging conical top parts of the cavities. These top cavities have thereby been excavated from the inside of the cavity or from the inside of shaft arranged in the corners of the polygonal shape.

It has however, been required dome-shaped ceilings, and substantially spherical cavities, whereby the diameter of the cavity could be substantially increased. It is since long well known that dome-shaped ceilings have very great bearing.

No optimal method for excavating such cavities does not exist today besides that it is known to use huge drills, so called cutterheads, when drilling circular tunnels where the ceiling encompasses an arcuate vault.

DESCRIPTION OF THE PRESENT INVENTION

It has now surprisingly been shown possible to be able to solve the above mentioned problem by means of the present invention, which is characterized in that one drills a first series of radially outwardly extending holes from a first distance from one or more shafts/tunnels, preferably radially arranged from the centre of a sphere projected; that one drills a second series of radially outwardly extending holes from a second, far more out arranged distance from the centre, which holes extend outside the holes of the first series; that one drills a third series of radially outwardly extending holes from a third, further far more out arranged distance from the centre, which holes extend outside the holes of the second series; that optionally further series of holes are drilled extending radially outwardly up to the boundaries of the cavity; that the holes of the first series are charged in their whole lengths; that each further series of holes are charged in that parts which are situated outside a charging area of a previous series of holes, whereby the charges will take consecutive annular charging areas, which cover the shape of the spherical cavity projected, and that blasting takes place of each annular area per se starting from inside out, or vice verse.

According to a preferred embodiment of the method drilling takes place beyond the sector which is to be produced, whereupon reinforcement and injection of these pastdrilled parts take place before a blasting of the spherical surface. How the long the past drilling shall take place depends of the need for reinforcement of the rock around the cavity.

A preferred embodiment of the invention for the production of a dome-shaped ceiling is characterized in that one optionally produces working and transport tunnels arranged the cavity projected; that one produces a vertical shaft from the upper part of the cylindrical cavity; that one drills from a first level a first series of radially outwardly extending holes; that one drills a second series of radially out-and downwardly extending holes from a second higher arranged level, which holes extend outside the holes of the first series; that one drills a third series of radially out-and downwardly extending holes from a third, further higher level, which holes extend outside the holes of the second series; that optionally further series of holes are drilled radially out-and downwardly extending up to the vertical limit of the storage cavity; that the first series of holes are charged in their whole lengths; that each further series of holes are charged in that part which lies outside a charging area of a previous series of holes, whereby the charges will take consecutive annular charging areas, which cover the shape of the spherical cavity projected, and that blasting takes place of each annular area per se starting from inside out, or vice verse.

Further characteristics are evident from the accompanying claims.

By means of the present invention very large, substantially spherical cavities or other cavities having a dome-shaped ceiling can be produced having a diameter of 100 m or more.

By applying three tunnels or shafts, which cross each other substantially at right angles a sphere can be produced in this way or it might be done by a combination of such tunnels/shafts and working and production tunnels, which lead in towards the cavity and/or by arranging tunnels around the cavity projected.

Normally a whole sphere is not excavated but the lower part is cylindrically and/or conically designed depending on the way of use.

The invention will be described more in detail with reference to the attached drawing without being restricted solely thereto.

Figure 1:
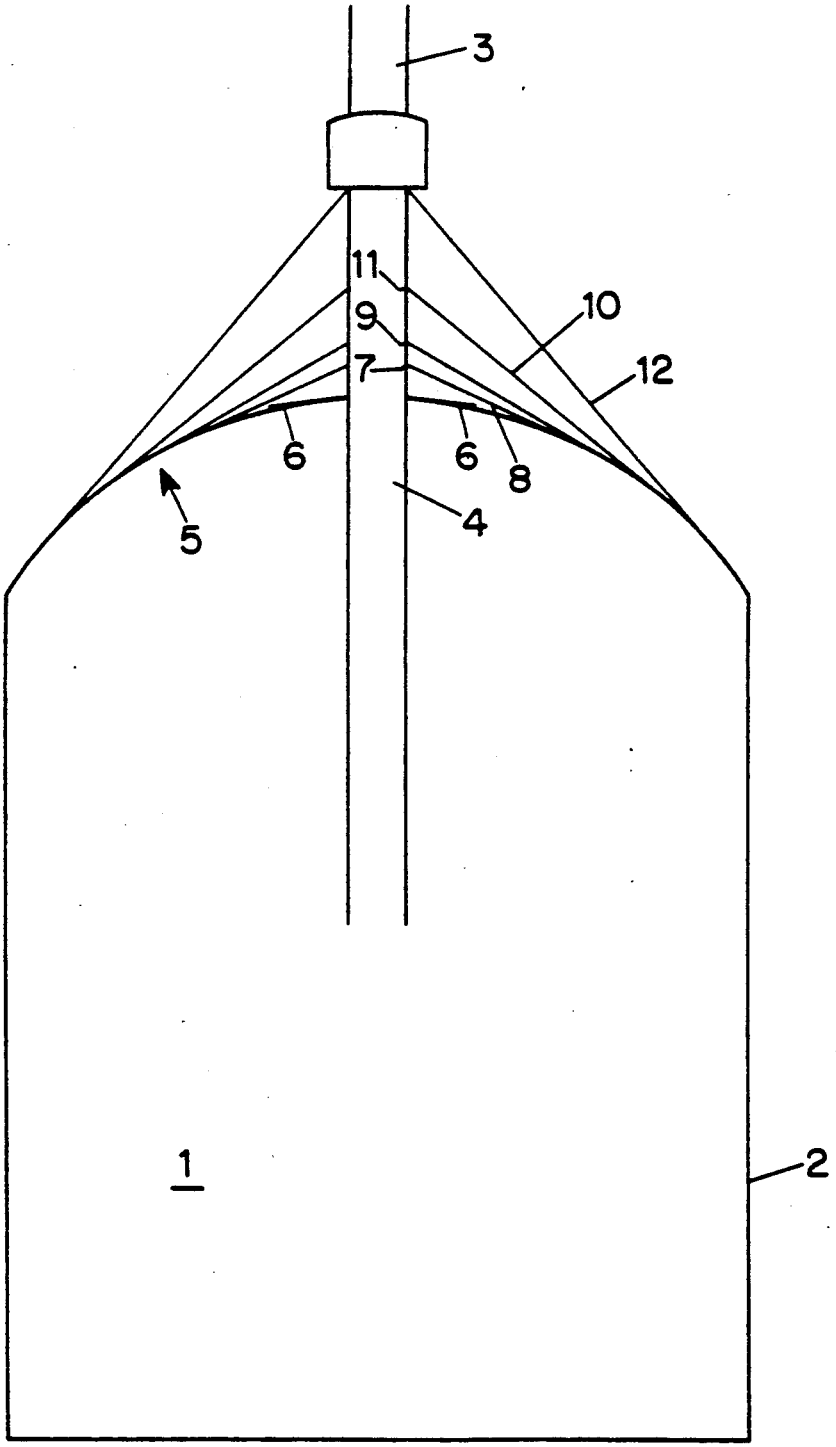
FIG. 1 shows a vertical cross-section through a substantially vertical cylindrical cavity.

1 denotes a projected cavity in a rock mass, which cavity according to FIG. 1 comprises a substantially cylindrical part 2 and a dome-shaped ceiling. The dome-shaped ceiling is excavated from a centrally arranged shaft 3 by drilling from a first level 4 situated in the upper part of the ceiling 5 to be a substantially horizontal ring of radial holes 6 which cover a circular sector closest to the shaft and optionally continue beyond the end point of the ceiling section if the rock around the cavity need to be reinforced. The part which is drilled beyond the end point of the ceiling section is reinforced and injected with a hydraulic binder. From a second level 7 a second ring of radial holes 8 are drilled, whereby the second level 7 lies above the first level 4 and whereby the holes 8 which cover a ring shaped sector outside the circular sector are somewhat angled outwardly-downwardly. The holes 8 hereby touch the end point of the part of the holes 6 which is to form the ceiling section of the holes 6 and continue downwardly-outwardly a further way as far as the holes 8 shall form ceiling section and continue downwardly-outwardly some further distance so far that is determined by the reinforcement requirement of the roof. Then a further ring of radial holes 10 are drilled from a third, further higher level 9, whereby these holes are further somewhat more angled downwardly. The holes 10 touch the end point of the holes 8 in that part of the holes 8 which is to form the ceiling section of the holes 8 and continue downwardly-outwardly for that part of the holes 10 which shall form ceiling section and continue further downwardly-outwardly as far as it is determined by the need for reinforcement. The holes 10 cover a further ring shaped sector outside the previous ring shaped sector. On a further higher level 11 a further ring of radial holes 12 are drilled, whereby these are further somewhat angled downwardly. The holes 12 touch the end point of the holes 10 in that part which is to form the ceiling section of the holes 10 and continue downwardly-outwardly as far as the holes 12 shall form ceiling section and continue further downwardly-outwardly as far as it is determined by the need for reinforcement of the roof. The holes 12 cover a further ring shaped sector. The angle of the holes 12 visavi the horizontal plane is now about 45°. The drilled holes 6, 8, 10, and 12 now cover a quarter of a sphere. For the blasting of the ceiling shape the holes 6 are charged completely, the holes 8 in that part which are situated outside the holes 6 and is then filled with sand up to the shaft in order to prevent cracking of this part at the blasting; the holes 10 are charged in that part which are situated outside the holes 8, whereby the parts towards the shaft are filled with sand; and the holes 12 are charged in that part which is situated outside the holes 10 and the rest of holes 12 are filled with sand in the same way as the other holes. The main part of the cavity 1 has previously been excavated by using conventional excavation, such as stop excavation from below and upwards (magazine blasting). By shooting the charges of the holes 6, 8, 10, and 12 inside and outwardly from the centre, or vice verse a substantial dome shape of the ceiling is obtained. As the holes are solely charged in that part which are situated in the part which shall form/create the ceiling and cautious blasting is used a dome shape will be obtained. The closer and the more levels that are used the more spherical the final surface will be. The holes 6, 8, 10, and 12 can then be emptied of sand and be used for reinforcement and injection with hydraulic binder of the roof area. Wire can also be drawn from one point in the shaft and down through a hole and then conducted in return through another hole whereupon the wire is stretched for straining the roof before the holes are injected and filled with a hydraulic binder (concrete).

Figure 2:
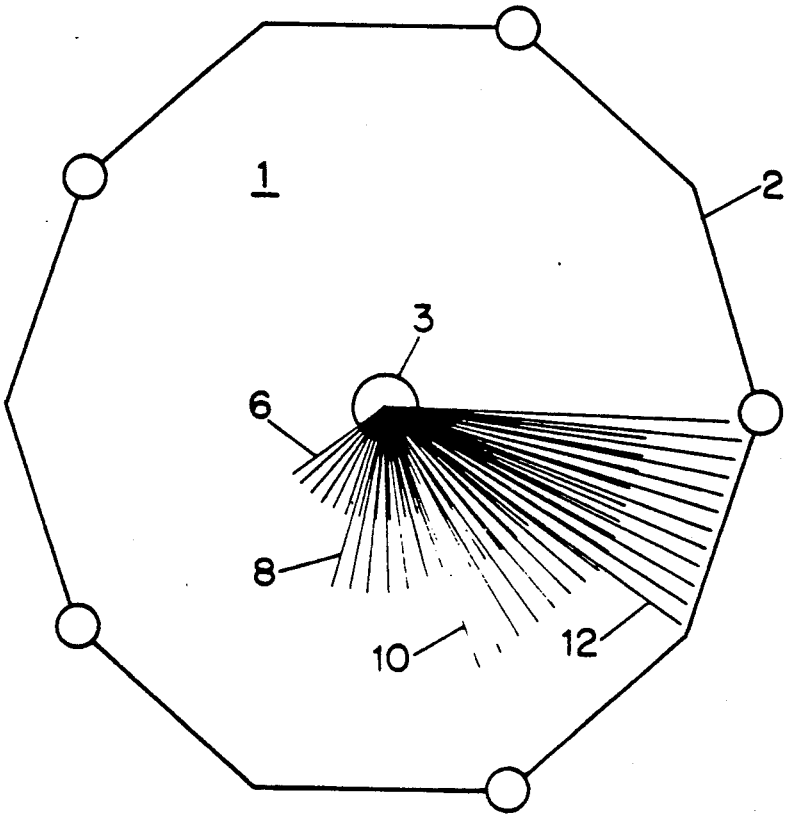
FIG. 2 shows an embodiment according to FIG. 1 seen from above.

In FIG. 2 it is shown that the substantially cylindrical cavity is decagonally shaped with 5 corner shafts. These shafts can also be used for straining the roof using wire or just for prestraining of the roof using wire or other reinforcement whereby holes are drilled from these shafts. Optional crack zones in the rock mass can thereby be injected via these drilled holes.

Figure 3:
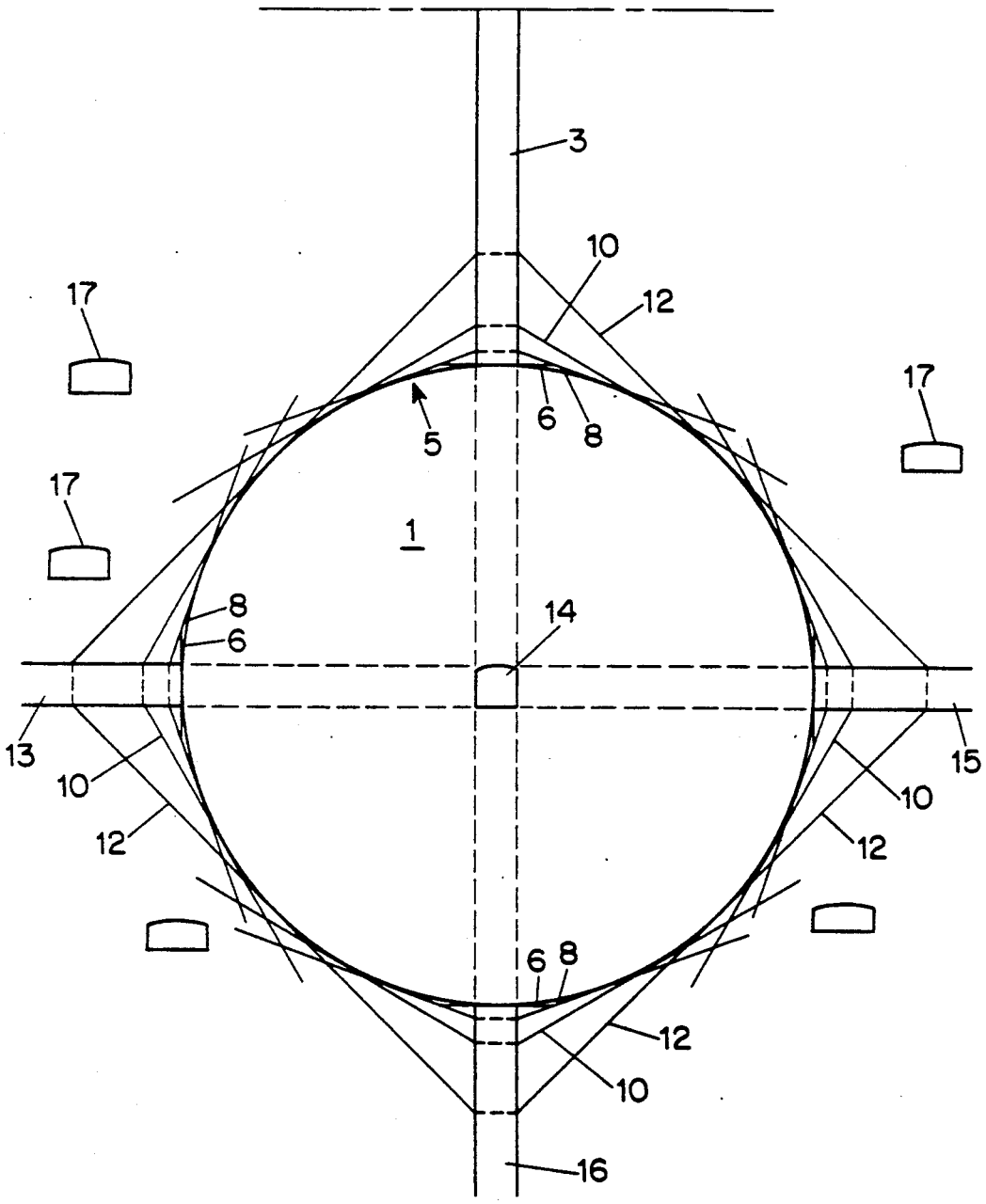
FIG. 3 shows a vertical cross-section through a substantially spherical cavity.

FIG. 3 shows a substantially spherical cavity. The spherical part of the cavity has been excavated in the way described above partly from a centre shaft 3, partly from four horizontal shafts (i.e. two perpendicularly crossing shafts) 13, 14, 15, and 16. Hereby radial holes are drilled from the tunnels 13, 14, 15, and 16 starting from closest to the wall, and from increasing distances from the centre of the sphere so that the end point of those holes which are drilled from the drilling place situated most far out in the shaft, meet the end points of the respective holes from a close shaft. The basic structure is excavated from a system of annular tunnels of which one 17 runs in a helical form from the ground level down to the bottom level 18 of the cavity, an upper annular tunnel 19 connects the different shafts for production drilling, and straining of the roof. For the excavation of the main part of the cavity 1 one goes down via the helical tunnel 17 to the unloading tunnel 18, the projected bottom level, whereupon a conventional excavation is carried out such as for example described in SE-C-8404728-1 (452,785). Then blasting takes place in the drilled holes 6, 8, 10, and 12 and the corresponding holes from the shafts 13, 14, 15, and 16.

Figure 4:
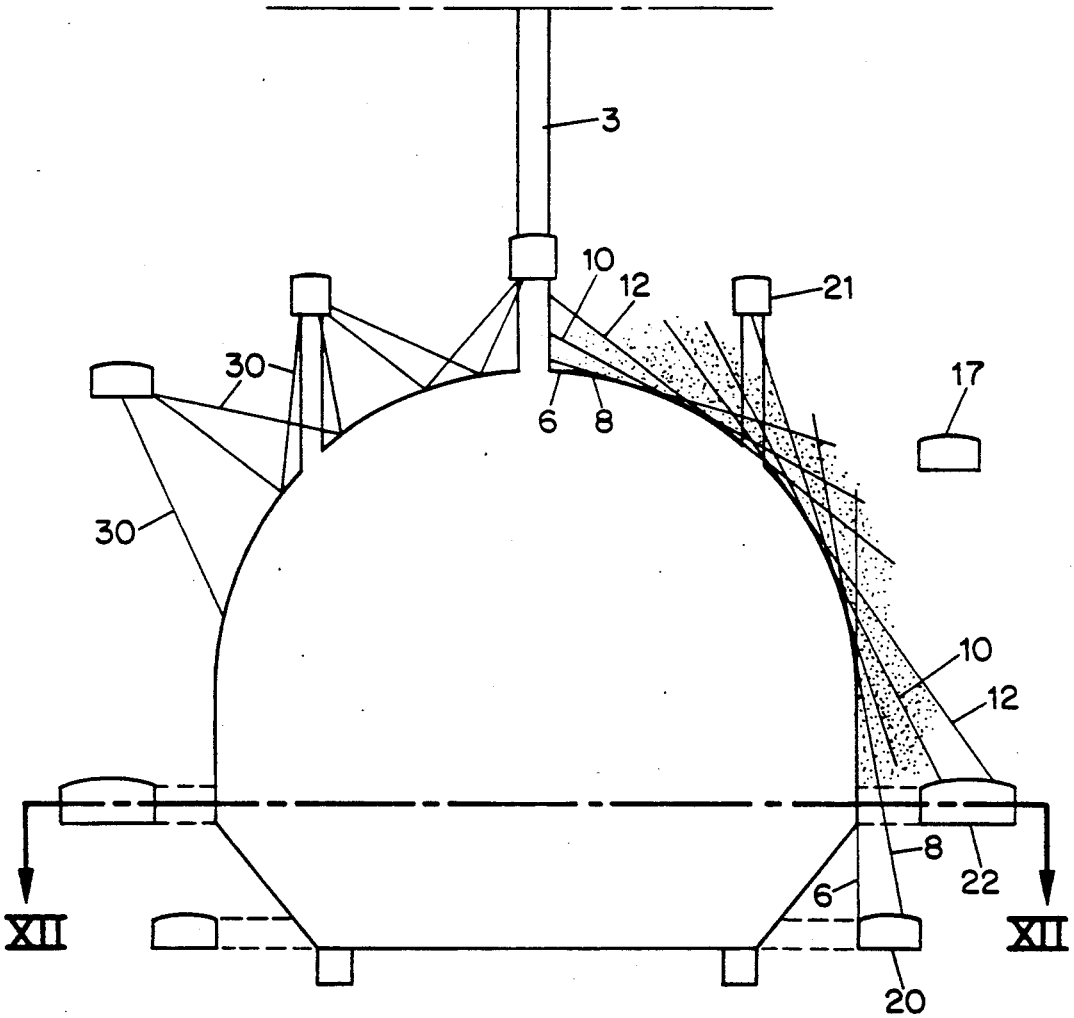
FIG. 4 shows the embodiment according to FIG. 3, whereby a different excavation way is given.
Figure 6:
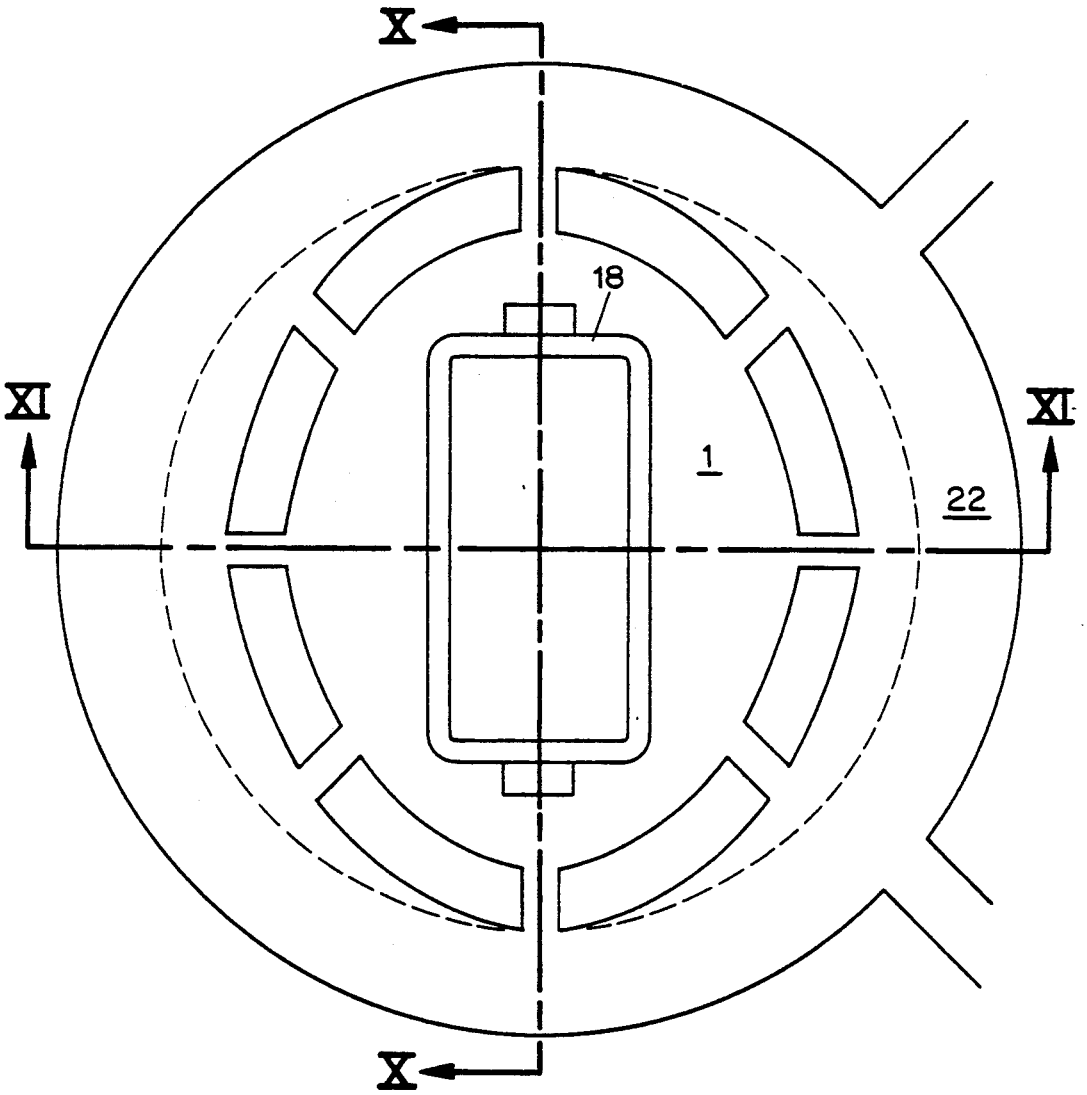
FIG. 6 shows a horizontal cross-section of the embodiment of a further embodiment.

FIG. 4 shows section X—X of FIG. 6 and shows that excavation of the spherical profile of the cavity takes place from the different tunnels arranged around the cavity, viz. from an upper annular tunnel 21 and from annular admittance and exit tunnels 20 and 22 and from the central shaft 3. Hereby it is drilled from the central shaft 3 in the manner disclosed above. From the annular tunnel 21 there is drilled with a certain given distance between the holes and with a certain angle up to the end point of a previous hole and further to the formation of a sector of drilled holes. Buy changing the angle of the drilled holes and varying the place more drilled hole sectors can be drilled from the annular tunnel. By moving the starting point of the drilled holes in the admittance and exit tunnels 20, and 22 the drilled hole sectors can be displaced outwardly for adaptation to the spherical profile and thereby for application of different drilled hole sectors.

Figure 5:
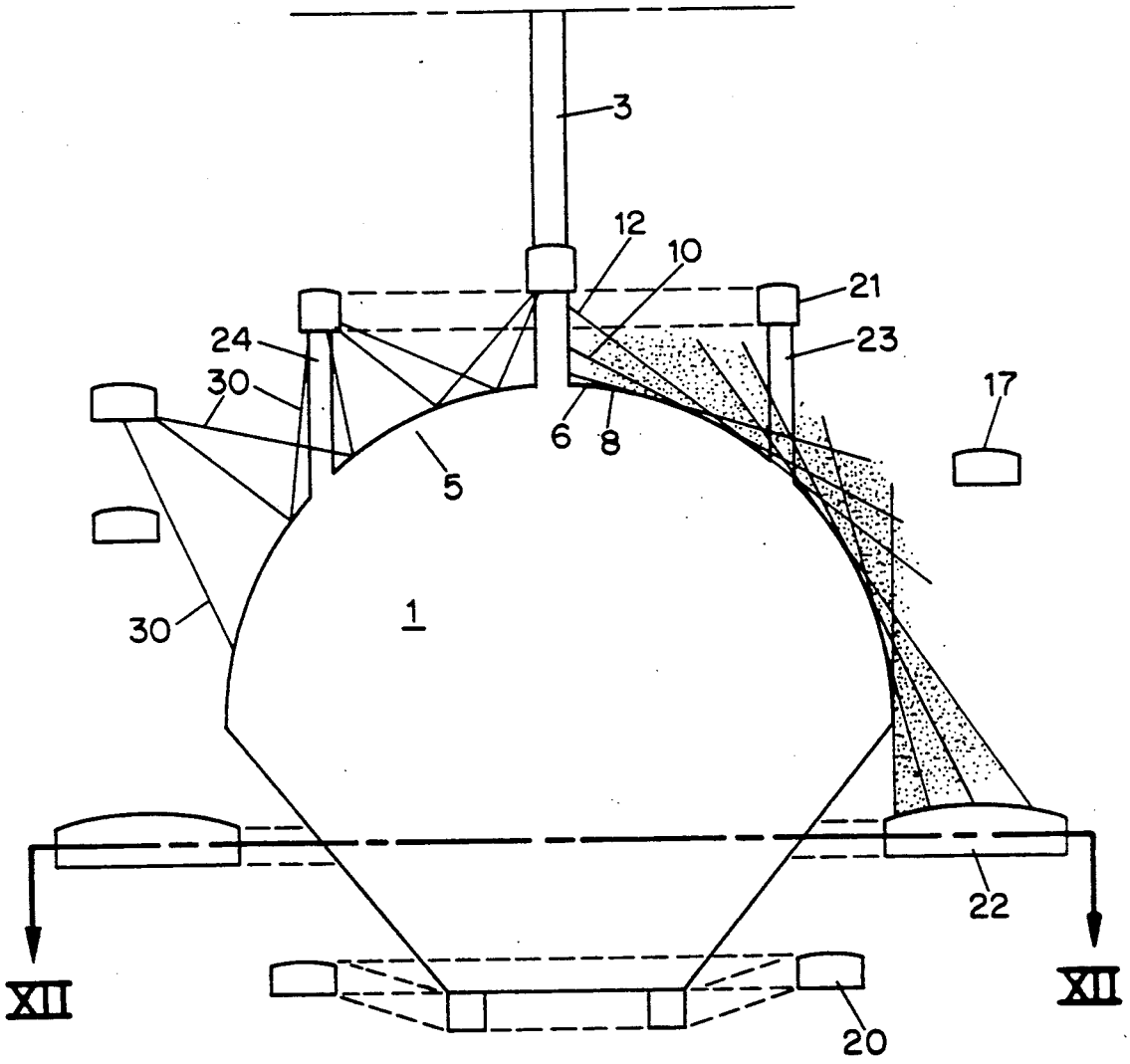
FIG. 5 shows a vertical cross-section through further embodiment having a substantially spherical cavity.

FIG. 5 shows a further embodiment according to the present invention for the drilling of the dome in section XI—XI of FIG. 6 starting from inside the central shaft 3 and the annular tunnel 22. Here one has carried out drilling beyond the ceiling structure and out into the surrounding rock. In these past drilled parts reinforcement and injection is carried out, whereby the whole rock mass around the cavity 1 is reinforced. This reinforcement and injection shall be carried out prior to the blasting of the spherical profile in order to achieve maximum strength. Wire stretching can be made from the tunnel 21 and the annular tunnel 17 and the central shaft 3. In the figure it is shown the use of production shafts situated in a circle around the central shaft 3, which production shafts can provide the basis for drilling and be used for production drilling for the excavation of the cavity.

It is apparent that past drilling and subsequent reinforcement and injection can be made in all embodiments above.

FIG. 6 shows an oval cross-section XII—XII of a cavity according to the present invention. The annular tunnel 22 surrounds hereby the cavity and from here the wall contour is drilled.

Figure 7:
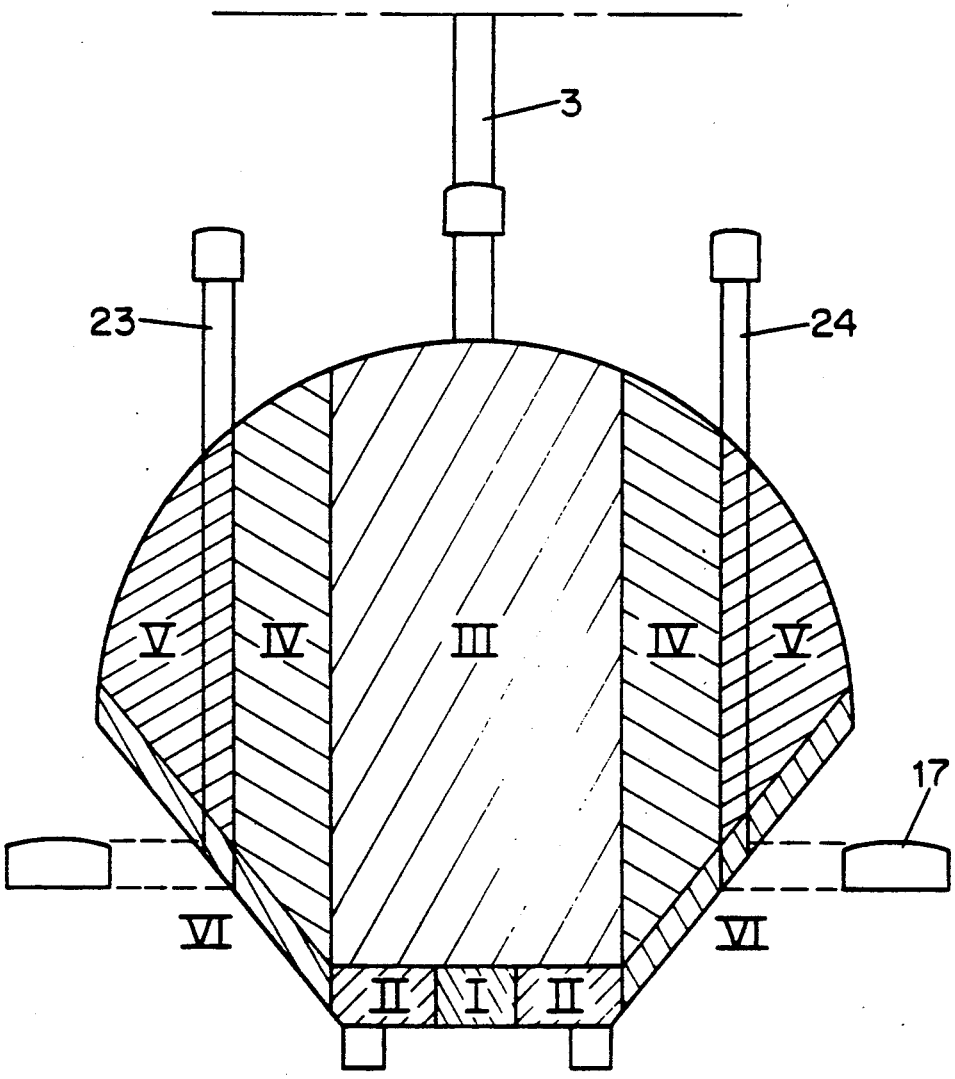
FIG. 7 shows a vertical cross-section of the embodiment according to FIG. 5 giving the blasting order for the inner parts of the rock cavity.

FIG. 7 shows a cross-section of an embodiment according to FIG. 5 in which the excavation of the inner cavity has been marked with different Roman numerals. Thus it is drilled from the bottom tunnel and is first blasted sections I and II, whereupon it is drilled from the central shaft out into the central body III, whereupon this is excavated and the rock masses are transported out through a bottom tunnel and the helical tunnel 17 or are brought up through a vertical shaft as e.g. at conventional mining. Then one drills and blasts that part of the ceiling which is situated above III, as well as the straining of wire in the roof then takes place, whereby reinforcement and injection in the past drilled zone has been made prior to the blasting of the profile. Then zone IV is excavated, a circular annular zone, the roof profile is excavated above this zone after reinforcement and injection, and wire straining takes place. The same is made with zone V. Drilling into zones IV and V can take place from the production shafts 23 and 24, which can be more than two and are situated in a circle with six, or eight, or more depending on the final diameter of the cavity. These production shaft are connected with an upper annular tunnel, such as the tunnel 21 of FIG. 4 mentioned above, from which drilling can take place to obtain the spherical surface.

Figure 8:
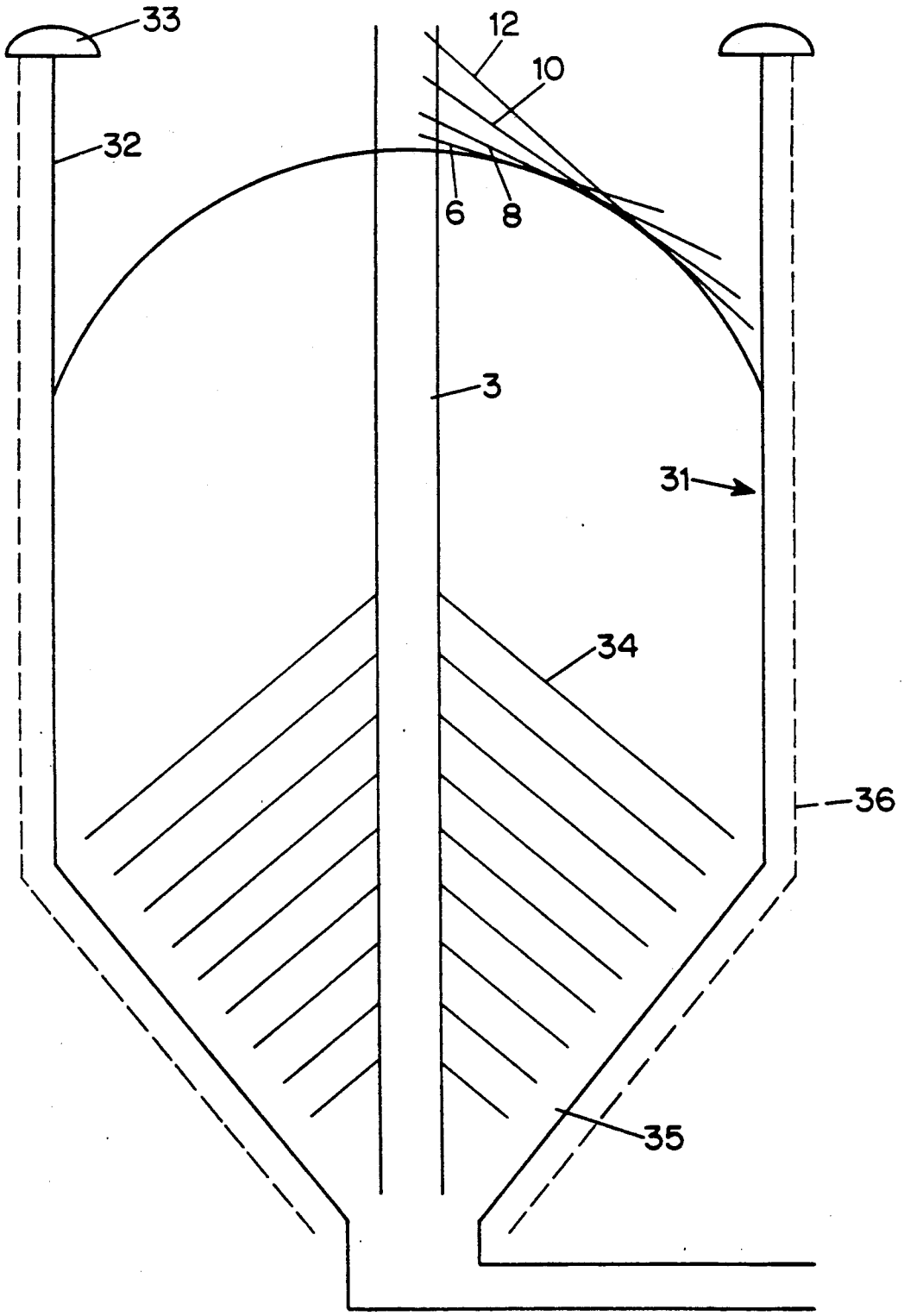
FIG. 8 shows a vertical cross-section of a further embodiment of the present invention.

FIG. 8 shows in cross-section a plant for storing e.g. liquids, such as fuel and raw petrol oil, whereby the top of the plant has been excavated as described above using a number of rings of drilled holes, and whereby the cylindrical wall 31 has been excavated using the similar technique, viz. vertical holes 32 have been drilled from the annular tunnel 33 and holes 34 have been drilled from the centre shaft 3 to produce the conical bottom part of the cavity, whereby the conical surface as such has been produced by drilling holes 35 from the bottom of the cavity. By blasting the rock masses in the central part first by charging and shooting charges placed in the holes 34, and then charging and shooting charges placed in the holes 35, and subsequent thereto the charges in holes 32 the substantial part has been excavated. Finally, the charges in the top holes 6, 8, 10, and 12 are shot to produce the ceiling structure. Outside the plant a shield of drilled holes 36 are situated to eliminate ground water coming in towards the plant. These drilled holes 36 forms what is called a hydraulic cage. Water trapped by the hydraulic cage is collected in the bottom of the plant and pumped away together with water condensed from the liquid stored.

I claim:

1. A method for excavating and preparing rock cavities having substantially spherically-shaped interior contours, which comprises:

drilling a first series of holes projecting radially outward for a first distance from a first plane of at least one shaft;

drilling any further series of holes projecting radially outward needed to reach the boundaries of the cavity such that each successive series of holes is radially arranged in a plane located a greater distance from the first plane of the first series of holes than a prior series of holes and each successive series of holes projecting radially outward beyond the holes of the prior series up to the boundaries of the cavity;

charging the first series of holes in their whole lengths;

charging the portions of each subsequent series of holes which extend beyond the prior series of holes and which does not extend beyond the point of the subsequent series of holes; and blasting each annular area from one boundary of the cavity of another, whereby the charges provide consecutive annular charging areas which cover the shape of the spherical cavity projected.

2. The method according to claim 1 for excavating and preparing dome-shaped ceilings in a substantially vertical, cylindrical cavity, wherein said at least one shaft is a substantially vertical shaft from the upper part of the cylindrical cavity, and subsequent series of holes are drilled at a higher arranged level from previous series of holes and said subsequent series of holes also extending outside any prior series of holes of the projected ceiling dome,, and blasting takes place at each annular area.

3. The method according to claim 1, characterized in that the holes (6, 8, 10, 12) in each series of holes are drilled up to the spherically shaped limiting surface projected.

4. The method according to claim 1, characterized in that the holes of a subsequent series of holes (8, 10, 12) are drilled in such a way that the subsequent holes touch the end point of the holes of a previous series of holes (6, 8, 10), whereby the continually of the holes of that series (8, 10, 12) after charging and blasting forms the contour of a annular section.

5. The method according to claim 1, characterized in that the holes after charging are filled with sand in that part which is not to be blasted.

6. The method according to claim 1, characterized in that the outermost series of holes (12) are charged in that part which is to form the contour of the ceiling; that the inner holes (6, 8, 10) are filled with sand prior to blasting of the outer holes (12), the outer holes (12) are blasted, whereupon each of the inner holes (6, 8, 10) are blasted subsequent thereto.

7. The method according to claim 1, characterized in that each part of each hole (6, 8, 10, 12) which have not been charged and blasted are reinforced and injected using a hydraulic binder to achieve a homogeneous rock mass.

8. The method according to claim 1, characterized in that the dome shaped ceiling is strained and/or prestrained by placing wires in the drilled holes and strengthening of the wires to said shaft, whereupon the drilled holes with their wires are injected with a hydraulic binder after blasting.

9. The method according to claim 8, characterized in that the roof is further strained using wire conducted through further holes (30) arranged, optionally from a further position (17, 20, 21, 22) outside the spherically shaped limiting surface.

10. The method according to claim 1, characterized in that drilling is carried out past the contour projected out into the surrounding rock mass, whereby these parts of the drilled holes (6, 8, 10,12) are reinforced and injected to reinforce the surrounding rock, if so needed.

11. The method according to claim 10, characterized in that reinforcement and injection take place prior to the blasting of the contour projected.

12. The method according to claim 1, characterized in that drilling takes place from tunnels (17, 20, 21, 22) situated outside the cavity (1) to the formation of the contour of the cavity (1).

* * * * *

UNITED STATES PATENT AND TRADEMARK OFFICE

CERTIFICATE OF CORRECTION

PATENT NO. : 5,104,259

DATED : April 14, 1992

INVENTOR(S) : Kurt Svensson

It is certified that error appears in the above-identified patent and that said Letters Patent is hereby corrected as shown below:

On the title page, item [57], last line of ABSTRACT, "vice verse" should read --vice versa--;

Col. 1, line 23, "consists" should read --consist--;

Col. 1, line 65, "verse" should read --versa--;

Col. 2, line 2, "How the" should read --How--;

Col. 2, line 29, "verse" should read --versa--;

Col. 3, line 57, "verse" should read --versa--;

Col. 4, line 44, "Buy" should read --By--;

Col. 6, line 29, "continually" should read --continuity--.

Signed and Sealed this

Second Day of November, 1993

Bruce Lehman

*Attest:*

BRUCE LEHMAN

*Attesting Officer*

*Commissioner of Patents and Trademarks*